United States Patent [19]

May

[11] 4,329,819

[45] May 18, 1982

[54] CENTRIFUGAL BLASTING APPARATUS

[75] Inventor: Harold V. May, Adrian, Mich.

[73] Assignee: Ervin Industries, Inc., Ann Arbor, Mich.

[21] Appl. No.: 141,468

[22] Filed: Apr. 18, 1980

[51] Int. Cl.[3] ..... B24C 5/06

[52] U.S. Cl. ..... 51/432; 51/434

[58] Field of Search ..... 51/432, 433, 434, 435; 241/275; 239/665, 222, 222.11, 224

[56] References Cited

U.S. PATENT DOCUMENTS

| | | | |
|---|---|---|---|
| 2,286,754 | 6/1942 | Minich | 51/432 |
| 2,344,989 | 3/1944 | Keefer | 51/432 |
| 3,921,337 | 11/1975 | Maeda | 51/432 |

FOREIGN PATENT DOCUMENTS

| | | | |
|---|---|---|---|
| 1577554 | 7/1970 | Fed. Rep. of Germany | 51/432 |
| 441466 | 1/1936 | United Kingdom | 51/432 |
| 898563 | 6/1962 | United Kingdom | 51/432 |

*Primary Examiner*—Nicholas P. Godici

*Attorney, Agent, or Firm*—Olsen and Stephenson

[57] ABSTRACT

Centrifugal blasting apparatus comprising a throwing wheel that rotates and forcefully projects a directional stream of particles for impingement against work pieces that are to be cleaned, peened, or otherwise treated by the particles, and a feed spout for supplying the particles continuously to the wheel. The feed spout terminates in an outlet section that has a conical surface formed with a discharge opening for the particulate material and is located concentrically within the particle impeller blades which form part of the wheel. The blades have inclined inner ends that are positioned in a closely spaced relation with the conical surface to provide for a discharge of particles from the discharge opening under the combined forces of gravity and suction induced by movement of the blades past the discharge opening.

4 Claims, 3 Drawing Figures

CENTRIFUGAL BLASTING APPARATUS

BACKGROUND OF THE INVENTION

Present methods of blast cleaning utilize a centrifugal throwing wheel for projecting abrasive particles, the particles being subjected to a pre-acceleration action before they are deposited on the inner ends of the blades in the throwing wheel. In some cases, a mechanically driven impeller feeds the abrasive particles to the inner ends of the impeller blades. In other cases, the particles are entrained in a moving stream of air which accelerates the particles prior to depositing them on the inner ends of the blades. In both cases, energy is required to achieve pre-acceleration of the particles and the wear of parts caused by the accelerated particles makes it difficult to control the blast pattern of the impelled particles on the work that is being processed.

It is an object of the present invention, therefore, to provide improved centrifugal blasting apparatus which is simple in construction, requires no moving parts for moving the particles onto the inlet ends of the impeller blades, and provides an improved control of the blast pattern which enables a confined and distinct blast pattern to be maintained during a prolonged service life of the apparatus.

SUMMARY OF THE INVENTION

The centrifugal blasting apparatus of this invention consists of a throwing wheel having particle impeller blades mounted so that they extend generally radially of the axis of rotation of the wheel. The inner ends of the blades are spaced apart to define a supply space for particulate material between the inner ends of the blades. A feed spout for gravity feeding particulate material onto the inner ends of the blades terminates in an outlet section located in the supply space. The outlet section has an outer conical surface which is positioned adjacent and in a closely spaced relation with the inner ends of the blades. The conical surface has a discharge opening formed in it through which particulate material will flow onto the inner ends of the blades during rotation of the throwing wheel to move the blades past the discharge opening. The combined forces of gravity and suction, induced by the blade movement past the discharge opening, provide for the required flow of particulate material from the feed spout section onto the inner ends of the blades.

The apparatus of this invention includes novel impeller blades that are inclined at their inner ends so that the inner ends can be positioned in a closely spaced, parallel relation with the conical surface on the outlet section of the feed spout. This relationship insures the generation of the negative pressure in the supply space for drawing the particulate material out of the feed spout outlet section and onto the inner ends of the impeller blades which are being driven so that they rotate at high speed about the throwing wheel axis and relative to the stationary feed spout outlet section.

The discharge opening in the feed spout for particulate material is generally trapezoidal in shape, corresponding to the shape of the spaces between the blades in the throwing wheel. This shape of the discharge opening insures a maximum flow of material from the feed spout outlet section onto the inner ends of the blade so that a maximum amount of particulate material can be thrown by the blasting apparatus. The opening of this shape also provides for the feeding of different amounts of particles to the impeller blades over the widths of each of the blades. Since each blade has an inclined inner end, it has a long edge and a short edge. The long edge of the blade has the smallest amount of abrasive fed to it, but this portion of the blade has the longest surface length, from end to end, and therefore particles traveling along the long edge are accelerated the most and leave the blade with the highest velocity.

The short edge of the blade is located adjacent the part of the discharge opening which is widest so this portion of the blade receives the largest volume of particles. However, particles leaving the outer end of the blade after having traveled along the short edge leave at the lowest velocity. Between the blade edges, the particle velocity is between the high and low edge velocities and the volume of particles is also between the high and low edge volumes.

The result is that the cleaning power of the particles leaving each blade is equalized over the width of the blade since one edge of the blade discharges fewer particles with each particle possessing more kinetic engery while the particles on the other side have less kinetic energy, but there are more of them.

In addition, in the apparatus of this invention, the feed spout outlet section is adjustably mounted for rotational movement about the axis of rotation of the throwing wheel thereby enabling adjustment of the position of the spout discharge opening relative to the inner ends of the blades to thereby adjust the pattern of particulate material thrown by the wheel.

Accordingly, this invention provides improved centrifugal blasting apparatus containing unique impeller blades having the advantages described above.

Further objects, features and advantages of the invention will become apparent from a consideration of the following description, the appended claims, and the accompanying drawing in which:

Figure 1:
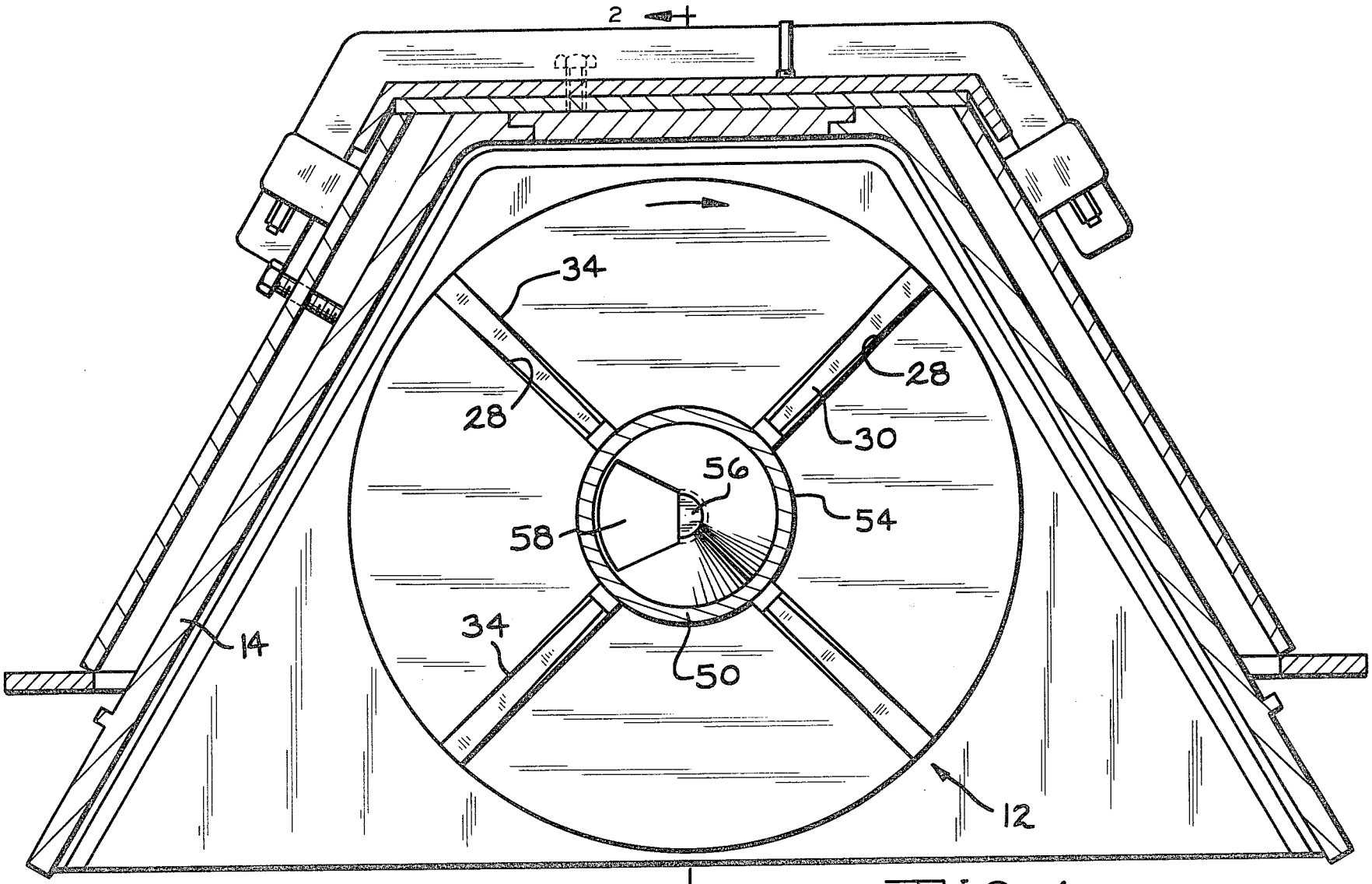
FIG. 1 is a sectional view of the centrifugal blasting apparatus of this invention looking in a direction axially of the throwing wheel, as seen from approximately line 1—1 in FIG. 2.

With reference to the drawing, the centrifugal blasting apparatus of this invention, indicated generally at 10, is shown in the drawing as consisting of a throwing wheel 12 rotatably mounted within a housing 14 and supplied with particulate material from a feed spout 16. The throwing wheel 12 includes a runnerhead 18 secured in a conventional manner to drive shaft 20 that is driven by a drive pulley 22 so that the runner head 18 is rotated about the axis 24 of the drive shaft 20. The runnerhead 18 has a planar support surface 26 that is perpendicular to the axis 24 and is provided with a plurality of support grooves 28 in which impeller blades 30 are mounted so that they extend generally radially of the axis 24.

Each blade 30 consists of a body 32, usually formed of cast metal, having a throwing surface 34 on one side. The body 32 also has an outer end 36 and an inner end 38 which is inclined with respect to the axis 24. The body 32 has a grooved mounting edge 40 disposed in the groove 28 and retained therein by a set screw 42 which engages a projection 44 on the edge 40. The body 36 also has a free edge 48 which is shorter in length than the mounting edge 40 due to the inclination of the inner end 38 of the body 32.

Figures 2, 3:
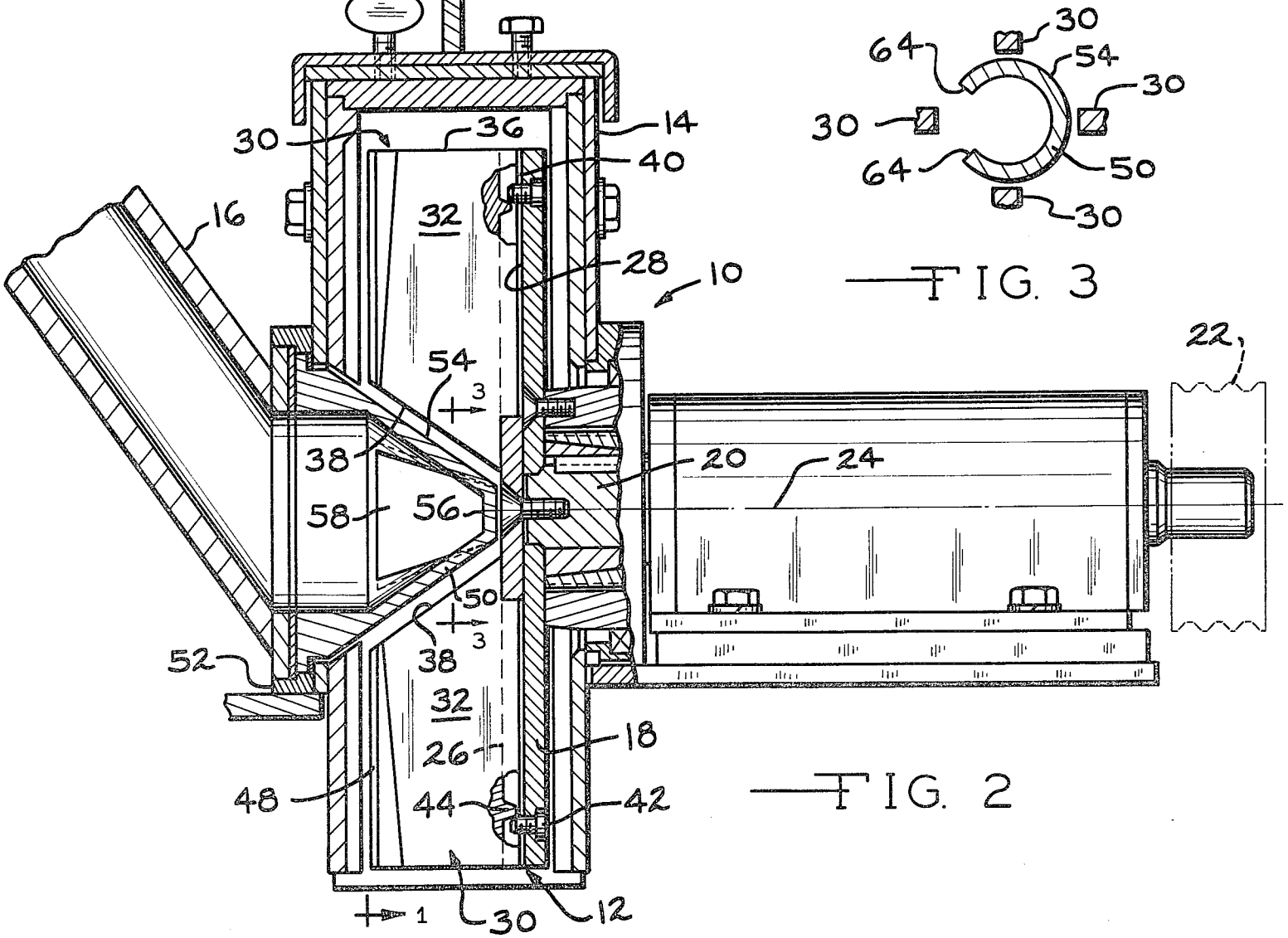
FIG. 2 is a longitudinal sectional view of the apparatus of this invention as seen from substantially the line 2—2 in FIG. 1, the impeller blades being shown in a moved position relative to the position shown in FIG. 1.
FIG. 3 is a detail sectional view of the feed spout outlet section and the inner ends of the impeller blades, as seen from substantially line 3—3 in FIG. 2.

The feed spout 16 is inclined downwardly toward the axis 24 at an angle of about fifty-five degrees and terminates at its lower end in an outlet section 50 that projects inwardly toward the planar surface 26 in a substantially coaxial relation with the drive shaft 20. As shown in FIG. 2, the spout section 50 is rotatably mounted in a support ring 52 so that it can be adjusted about the axis 24 for a purpose to appear presently.

The spout section 50 has a conical outer surface 54 and is illustrated as being frusto-conical in shape, although it is to be understood that the section 50 can be conical in shape, if desired; the important feature of the section 50 being the conical surface 54. As shown in FIG. 2, the inner end wall 56 of the section 50 terminates adjacent and in a closely spaced relation with the planar surface 26.

A discharge opening 58 for particulate material is formed in the spout section 50 so that it extends through the conical surface 54. The opening 58 is generally trapezoidal in shape and is of a length, in a direction parallel to the axis 24, approximately equal to the width of an impeller blade 30. In a direction circumferentially of the surface 54, the opening 58 is of a progressively increasing width in a direction extending away from the planar surface 26. As a result, the discharge opening 58 is wider at a position adjacent the short edges 48 of the impeller blades 30 than it is at a position adjacent the longer edges 40 of the blades 30.

In the operation of the apparatus 10, a mixture of air and a desired particulate material, such as metal shot for abrasive cleaning purposes, is continuously fed to the feed spout 16. The drive pulley 22 is rotated to drive the drive shaft 20 to in turn rotate the impeller blades 30 at high speed (about 3000 r.p.m.) about the axis 24. By virtue of the closely spaced relation of the inclined inner ends 38 of the blades 30 and the conical surface 54 in which the discharge opening 58 is located, and the rotation of the impeller blades 30, a suction is created at the discharge opening 50 tending to draw particulate material out of the spout section 50 and onto the inner ends of the blades 30 as they move past the discharge opening 58. The force of gravity also causes this movement because the discharge opening 58 is below the shot in the feed spout 16.

Shot from the opening 58 is deposited on the inner ends of the blades 30 as they move past the opening 58, the rate at which the shot is deposited on each wheel 30 adjacent the free edge 48 thereof being higher than the rate at which shot is deposited on the wheel adjacent the mounting edge 40. This difference in rate is due to the fact that the discharge opening 58 is wider at one end than it is at the other. Conversely, the shot deposited on the blades 30 adjacent the mounting edges 40 thereof has a longer distance to travel on the blades 30 before it is thrown from the free ends 36 thereof, and as a result, this shot is traveling at a higher velocity when it leaves the blades than is the shot leaving the blades 30 at the free edges 48. The result is a relatively even distribution of the kinetic energy-applying capabilities of the shot from each blade 30 over the width of the blade.

The shot blast pattern from the throwing wheel 12 is predictable, precise, and maintainable within these predictable and precise limits over an extended period of use of the wheel 12 because no moving parts are required to feed the shot from the spout 16 onto the inner ends 38 of the blades 30. This arrangement minimizes the possibility of wear of parts that might affect the blast pattern. As shown in FIGS. 2 and 3, the edges 64 of the discharge opening 58 are inclined outwardly in the direction of flow of shot from the spout section 50 so as to minimize the effect of the moving shot on the size of the opening 58. This enables prolonged use of the spout section 50 over an extended service life without requiring replacement because of wear of the discharge opening edges 64.

The spout section 50 can be rotated about the axis 24 to adjust the circumferential position of the shot discharge opening 58 to in turn adjust the blast pattern of the wheel 12.

From the above description, it is seen that this invention provides an improved centrifugal blasting apparatus which is simple to manufacture because of the reduced number of moving parts and economical to operate because no preacceleration of the particulate material is required in order to deposit the material on the inner ends of the impeller blades 30. By virtue of the cooperative arrangement of the conical surface 54 and the inclined inner edges 38 of the impeller blades 30 which are parallel to and in a closely spaced relation with the surface 54, the necessary suction is created to draw the particulate material out of the spout section 50 through the discharge opening 58. The axis 24 can be located in substantially any desired position necessary to obtain a particular blast pattern so long as the particulate material in the spout 16 will flow by gravity through the opening 58. The housing 14 is shown for illustrative purposes only, no particular housing being required for the apparatus 10. Further, the apparatus 10 is described with reference to rotation of the wheel 12 in the direction of the arrow in FIG. 2. It is pointed out that it can also be rotated in the opposite direction and the spout section 50 adjusted to achieve a desired blast pattern. Thus, both sides of the blades 30 can function as throwing surfaces.

What is claimed:

1. Centrifugal blasting apparatus comprising a runnerhead mounted for rotation about its central axis, said runnerhead having a planar support surface perpendicular to said axis, a plurality of particle impeller blades mounted on said surface so as to extend generally radially of said axis, the inner ends of said blades terminating at positions short of said axis and being inclined in directions radially outwardly and away from said support surface, the inner ends of said blades being spaced apart to define a supply space for particulate material between the inner ends of said blades, and a feed spout for gravity feeding particulate material onto the inner ends of said blades, said feed spout extending downwardly at a position to one side of said blades and terminating in an outlet section located in said supply space in a closely spaced relation with said runner head, said outlet section having an outer conical surface portion positioned adjacent and in a closely spaced relation with the inner ends of said blades, said conical surface portion having a discharge opening formed therein through which particulate material will flow from said spout section onto the inner ends of said blades during rotation of said runnerhead to move said blades past said opening under the combined forces of gravity and suction induced by said blade movement.

2. Apparatus according to claim 1 wherein said spout section conical surface has portions that are substantially parallel to the inner ends of said blades in all moved positions of the blades.

3. Apparatus according to claim 2 wherein said discharge opening is of a length in the direction of said axis corresponding substantially to the width of said blades and is of a progressively increasing width in a direction extending away from said runnerhead.

4. Apparatus according to claim 1 wherein said spout section is adjustably mounted for rotational movement about said axis to adjust the position of said discharge opening relative to said blades to thereby adust the pattern of particulate material thrown by said blades.

* * * * *